US007540679B2

(12) United States Patent
Fukui et al.

(10) Patent No.: US 7,540,679 B2
(45) Date of Patent: Jun. 2, 2009

(54) VARIABLE GRIP STRUCTURE

(75) Inventors: Hisao Fukui, Tokyo (JP); James Sener, Glastonbury, CT (US); Kevin J. Costello, Syosset, NY (US); Dave Mathieu, Glastonbury, CT (US)

(73) Assignees: Pentel Kabushiki Kaisha (JP); Pentel of America, Ltd.

( * ) Notice: Subject to any disclaimer, the term of this patent is extended or adjusted under 35 U.S.C. 154(b) by 590 days.

(21) Appl. No.: 10/531,924

(22) PCT Filed: Oct. 21, 2003

(86) PCT No.: PCT/JP03/13413

§ 371 (c)(1),
(2), (4) Date: Apr. 19, 2005

(87) PCT Pub. No.: WO2004/037552

PCT Pub. Date: May 6, 2004

(65) Prior Publication Data

US 2006/0045604 A1 Mar. 2, 2006

(30) Foreign Application Priority Data

Oct. 23, 2002 (JP) ..... 2002-308332

(51) Int. Cl.
*A46B 5/02* (2006.01)

(52) U.S. Cl. ..... 401/6

(58) Field of Classification Search ..... 401/6, 401/7; 15/435; 16/430
See application file for complete search history.

(56) References Cited

U.S. PATENT DOCUMENTS 5,263,275 A * 11/1993 Rumbaugh ..... 43/23
6,146,038 A * 11/2000 Mittersinker et al. ..... 401/6

FOREIGN PATENT DOCUMENTS

| | | |
|---|---|---|
| JP | 45016087 | 7/1970 |
| JP | 48051434 | 7/1973 |
| JP | 59076378 | 5/1984 |
| JP | 2607456 | 12/1994 |
| JP | 09169194 | 6/1997 |
| JP | 00313193 | 11/2000 |
| JP | 01001681 | 1/2001 |

* cited by examiner

*Primary Examiner*—Huyen Le
(74) *Attorney, Agent, or Firm*—Adams & Wilks

(57) ABSTRACT

A variable grip structure has a shaft body formed of plural shaft portions that are rotatable relative to one another. An elastic finger-grip member encircles the shaft body and has its forward and rearward ends fixed to different shaft portions so that relative rotation of the shaft portions elastically twists the finger-grip member about the longitudinal axis of the shaft body. This construction makes it possible to adapt the shape of the finger-grip member to the hand size and shape and the preference of the user.

21 Claims, 10 Drawing Sheets

VARIABLE GRIP STRUCTURE

TECHNICAL FIELD

The present invention relates to a grip structure having a grip portion consisting of an elastic member. Examples of those having such a grip include writing tools such as mechanical pencils, ball-point pens and whiteout (eraser) pens, cutting tools such as snap-off blade knives, chisels and screw drivers, input pens for use in personal digital assistants (PDAs) and electronic notebooks, and bicycle handle bars.

BACKGROUND ART

Attempts have been made in pursuit of better gripping performance of such grip structures as those mentioned above. One example of them is a research and development project involving contrivances regarding the hardness, surface state and shape of the grip portion.

However, since a grip portion of an elastic member is usually fixed to the shaft cylinder, there is a limit to the satisfaction of the gripping person on account of the size of the gripping hand and his or her personal preference.

In order to solve this problem, an inventive method was suggested by which the grip is formed to match the shape of the user's fingers (see Reference 1: Japanese Patent Application Laid-Open 2001-001681, (Claim 1 and FIG. 1). However, as this would require an impression material and a mold, it would be expensive and, moreover, not only the molding work is troublesome but also the writing tool, though good for its user, would result in an exclusive use for only him or her (the user).

Then, there was made an attempt fir partially expanding or contracting the grip portion by turning the shaft cylinder (see Reference 2: Japanese Patent Application Laid-Open 2000-313193 (Claim 1, FIG. 1 and FIG. 2)).

However, according to Reference 2 cited above, though the grip portion can be expanded or contracted in the radial direction, it still left room for further development. Thus, according to Reference 2, as the expansion or contraction takes place uniformly in the circumferential direction, specific fingers are caused to feel unpleasant. Thus, a writing tool is usually gripped with three fingers including the thumb, index finger and middle finger. If, however, the grip portion is expanded (contracted) and adjusted mainly on the basis of the thumb, the index finger and middle finger will feel unpleasant.

In addition to the above, there were a wide variety of requirements regarding the relative hardness (hardness or softness) of the grip portion and, as a user mainly concerned about the relative hardness tends to purchase a product of a relative hardness meeting his or her preference, this again would result in a writing tool for only an exclusive use by that particular person (user).

SUMMARY OF THE INVENTION

The present invention essentially permits an elastic member and a shaft body which fixes the elastic member to be rotatable relative to each other and provides means for keeping their relative rotating actions, and is intended to enable each of various users gripping the object to select a state in which he or she can sense the best feeling of gripping.

According to the invention, there is provided a variable grip structure characterized in that it has an elastic member and a shaft body fixing the elastic member, which are rotatable relative to each other, and means for keeping their relative rotating actions.

In the foregoing structure, the sectional shape of the elastic member can be made a deformed shape.

Also in the foregoing structure, slits or grooves can also be formed in the direction of the length of the external face of the elastic member.

Also in the foregoing structure, the hardness of the elastic member can also be made partially different.

Further, the surface roughness of the elastic member can also be made partially different and varied.

Also in the foregoing, it is also possible to provide a structure in which the elastic member is configured of a base material and a non-base material, the non-base material area is partially provided in the base material, and the hardness of the non-base material area is made greater than the hardness of the base material.

Further in the foregoing structure, it is also possible to provide a structure in which means of fixing the elastic member to the shaft body is provided such that at least one engaging portion is formed in either the internal face or the external face of each end of the elastic member, and an engagement receptacle portion which will be engaged with the engaging portion is formed on at least either one of a forward member positioned ahead of the grip portion and a rear member positioned behind the grip portion.

Also in the foregoing, the sectional shape of the engaging portion and engagement receptacle portion can be T-shaped.

Also in the foregoing, it is also possible to provide a structure in which the engaging portion and the engagement receptacle portion are respectively a hole and a stub engaging with the hole.

Also in the foregoing, it is also possible to provide a structure in which the engaging portion and the engagement receptacle portion are formed in a direction substantially parallel to the direction of the length of the shaft body.

Also in the foregoing, it is also possible to provide a structure in which the engaging portion and engagement receptacle portion are formed on at least either one of the forward end face and the rear end face of the grip.

Also in the foregoing, the engaging portion and engagement receptacle portion can also be formed in a direction perpendicular to the direction of the length of the shaft body.

Also in the foregoing, it is also possible to provide a structure in which a stopping portion is formed on the internal face of the grip, and that stopping portion is held between a plurality of shaft cylinders.

Also in the foregoing, it is also possible to provide a structure in which the elastic member is held, in a state of being compressed in the lengthwise direction, between the forward member and rear member.

Also in the foregoing, it is also possible to provide a structure in which a ring-shaped member composed of an elastic material intervenes inside either one of the forward member and the rear member rotating relative to each other.

Also in the foregoing, it is also possible to provide a structure in which the forward member and the rear member rotating relative to each other are brought into contact and ribs which are engaged with and disengaged from each other are formed in the contacting portions.

Also in the foregoing, it is also possible to provide a structure in which the forward member and the rear member rotating relative to each other urge each other.

Also in the foregoing, ribs which are engaged with and disengaged from each other can also be formed on the internal faces or the external faces of the forward member and rear member rotating relative to each other.

Also in the foregoing, a restricting part can also be provided to restrict in the rotating directions of the forward member and rear member rotating relative to each other.

Further according to the invention, there is provided a variable grip structure for a writing tool, wherein the cylindrical body of the writing tool has a grip body composed by coupling in series a substantially cylindrical elastic member between a forward shaft constituting the cylindrical body and a rear shaft, the forward end of the elastic member is fixed to the rear end of the forward shaft, the rear end of the elastic member is firmly adhered to the forward end of the rear shaft, and a rotational mechanism is provided in the serially coupled grip body to enable the forward shaft and the rear shaft to rotate relative to each other and to be stopped in a prescribed rotational position.

In the variable grip structure according to the invention, a concave portion and a convex portion are formed in a twisted state in the grip portion deformed by rotation, and fingers can be positioned on the twisted concave portion. The angle of twist can be selectively adjusted by each individual user as he or she likes. As the grip portion is extended or contracted by the twisting operation, the hardness of the grip portion can be varied according to the angle of twist.

DETAILED DESCRIPTION OF THE INVENTION

Modes for carrying out the invention will be illustrated, and will be described in detail with reference to the drawings.

Figure 1:
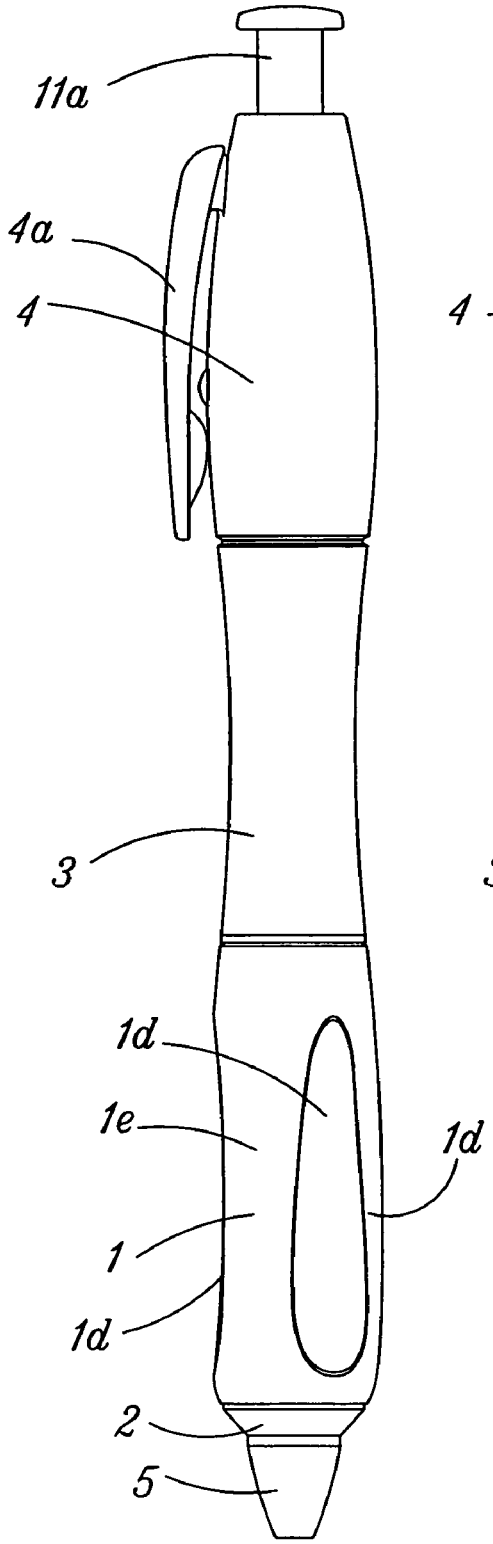
FIG. 1 is an external view showing an example in which a variable grip structure according to the invention is used in a writing tool.
Figure 2:
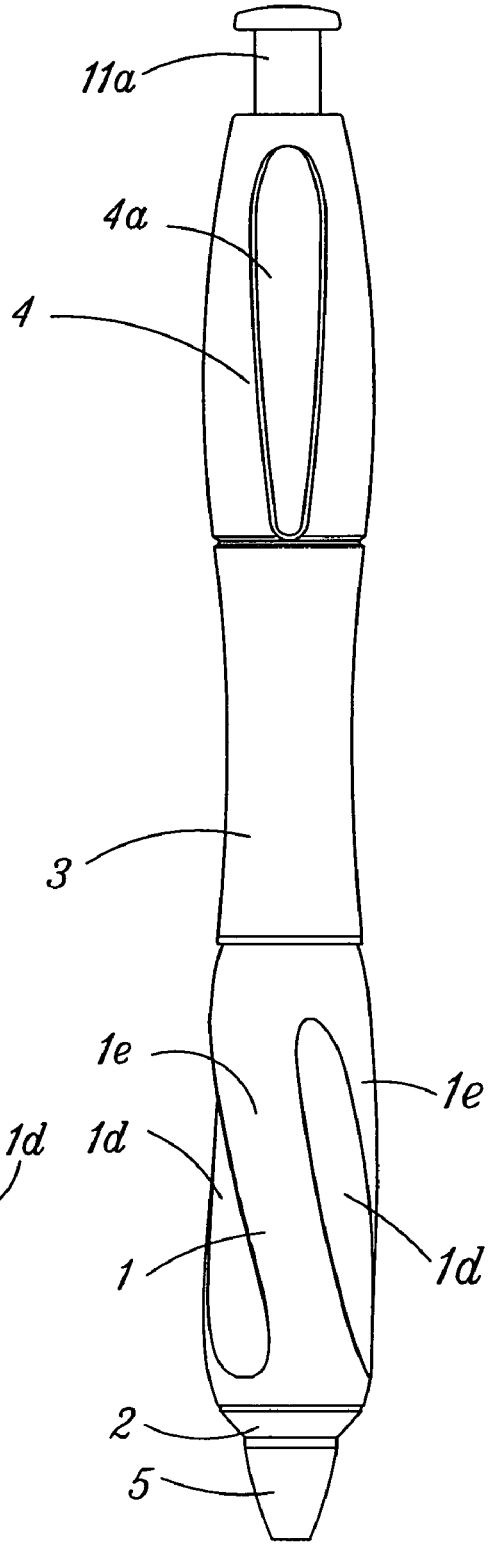
FIG. 2 is an external view showing an action of the grip structure of FIG. 1.
Figure 4:
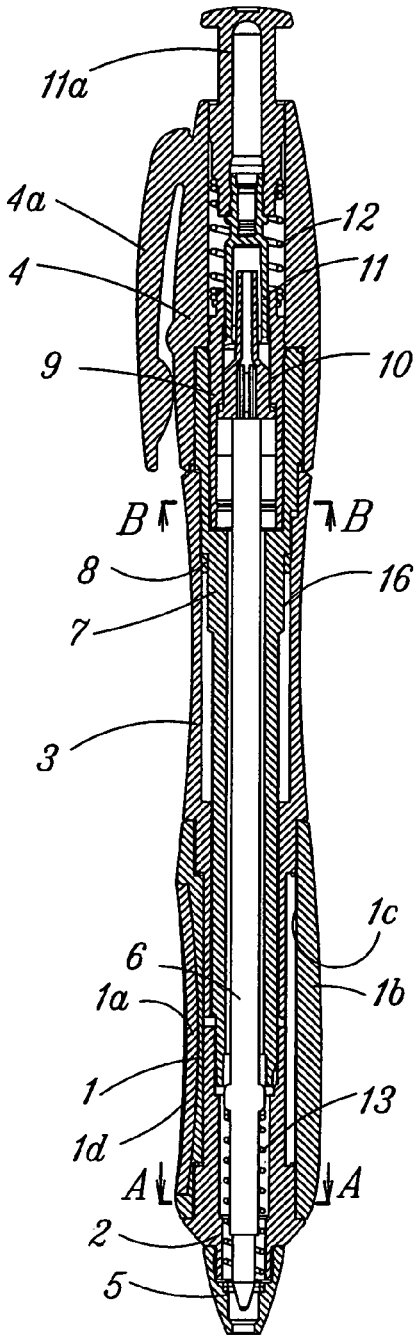
FIG. 4 shows a longitudinal section of FIG. 1.
Figure 3:
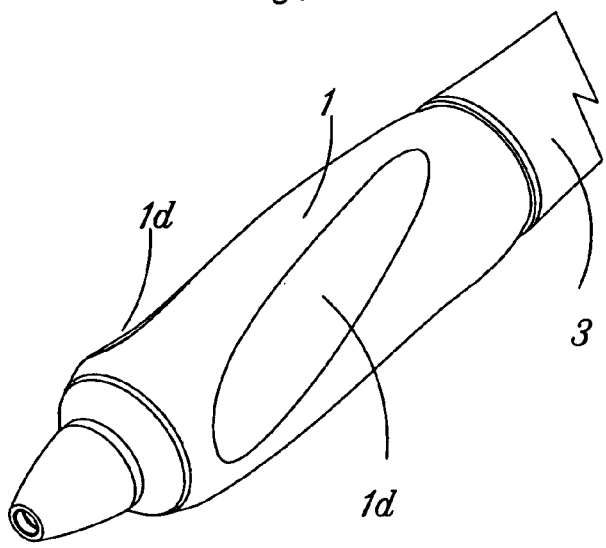
FIG. 3 is a perspective view showing the essential part of FIG. 2.

A first embodiment of the invention will be described with reference to FIG. 1 through FIG. 4. FIG. 1 is an external view showing a case that there is no rotation of an elastic member relative to a shaft body. Reference numeral 1 denotes a grip portion made of a soft elastic member (elastic finger-grip member), and the grip portion 1 has a hollow portion 1*c*. As illustrated, the grip portion 1 is disposed around and encircles the shaft body. The forward end side (the lower side in the drawing) of the grip portion 1 is unrotatably (non-rotatably) fixed to a forward shaft (forward member) 2. On the other hand, the rear end side (the upper side in the drawing) of the grip portion 1 is also unrotatably fixed to a middle shaft (rear member) 3. Its rear or rearward shaft 4, though unrotatably fixed to the forward shaft 2 via a linking member 7, is rotatably arranged relative to the middle shaft 3. Therefore, when the middle shaft 3 and rear shaft 4 are held with fingers or the like and rotated relative to each other, the forward shaft 2 rotates together with the rear shaft 4 by way of the linking member 7 (FIG. 4). This causes the grip portion 1 to be rotationally deformed in a twisted state (FIG. 2). Incidentally, as the grip portion 1 is also rotationally deformed when the forward shaft 2 and the middle shaft 3 are held with fingers and rotated relative to each other, it is not absolutely necessary to link the forward shaft 2 and the rear shaft 4 with the linking member 7 as in the manipulation described above. The forward, middle and rearward shafts 2, 3, 4 constitute shaft portions that are arranged in series to form a shaft body.

Figure 5:
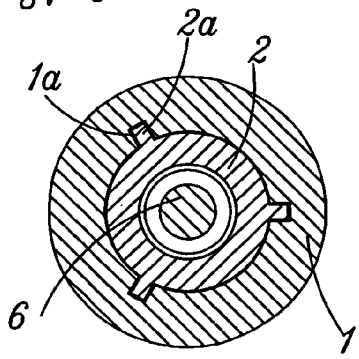
FIG. 5 shows a section of a variation of the method of fixing a grip portion to a forward shaft.

An embodiment of the invention will be described in detail with reference to FIGS. 4 and 5. A plurality of recesses, such as grooves 1*a*, are formed inside the grip portion 1 in the forward part, and engage with a plurality of projections, such as stubs 2*a*, formed in the rear part of the forward shaft 2. This causes one (forward) end of the grip portion 1 to be unrotatably fixed to the forward shaft 2. A plurality of grooves la are also formed in the rear part of the inside of the grip portion 1, and engaged with a plurality of stubs 2*a* formed outside the middle shaft 3, resulting in unrotatable fixation of the other (rear) end of the grip portion 1 to the middle shaft 3. The means of fixing the grip portion 1 to the forward shaft 2 and to the middle shaft 3 are not limited to grooves (or stubs) 1*a* formed at the two ends of the grip portion 1 and stubs (or grooves) 2*a* formed on (in) the forward shaft 2 and the middle shaft 3 to engage with the grooves 1*a*, but other suitable fixing means or method as an adhesive, thermal fusion, ultrasonic deposition, caulking or press-fitting may be used.

Figure 6:
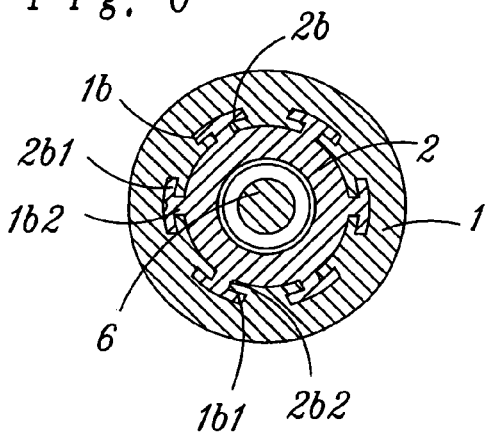
FIG. 6 shows a section along line A-A in FIG. 4.

Also, various cases are applicable without being restricted to the pluralities of stubs and grooves. An example of such variation is shown in FIG. 6 and will be described. A plurality of T-shaped grooves 1*b* are formed at the forward end of the inside the grip portion 1, and a plurality of T-shaped stubs 2*b* formed in the rear part of the forward shaft 2 engage with these T-shaped grooves 1*b* in an inserted state. Thus, the forward part of the grip portion 1 is unrotatably fixed to the forward shaft 2. The T-shape intends to mean and include a configuration in which a wider groove 1*b*1 (or stub 2*b*1 protruding from the forward shaft 2) is formed in a part distal to the shaft center in the cross section and a narrower groove 1*b*2 (or stub 2*b*1 protruding from the forward shaft 2) in a part proximal to the shaft center. By forming the means of engaging the grip portion 1 and the forward shaft 2 in a T-shape in this way, the deformation of the linking portion to the forward shaft 2 at an end face of the grip portion 1 with the relative rotation can be kept to the minimum possible, and the grip portion 1 is thereby prevented from coming off the forward shaft 2.

Though this embodiment is a retractable writing tool having a ball-point pen 6 in a shaft body, a mechanical pencil, a solid correcting tool or the like may be disposed as well. Further, a gap 16 is formed between the middle shaft 3 and the linking member 7, and a friction ring 8 which consists of a soft member and whose sectional shape is rectangular, circular or oval is formed in the gap 16 to provide a frictional resistance force against the relative rotation of the middle shaft 3 and the linking member 7. In other words, a frictional resistance force in the rotating direction is provided so that the restoring action of the grip portion 1 is prevented when the middle shaft 3 and the grip portion 1 are rotated relative to each other. Thus, the friction ring 8 obstructs the restoring action occurring when the grip is twisted. Further, the internal face in which the ring 8 is positioned from the rear end of the middle shaft 3 is in a conical shape, slightly expanding the part in which the ring 8 is positioned toward the rear end. By fitting the ring 8 to the linking portion 7 and then minimizing the frictional resistance occurring between the ring 8 and the internal face of the middle shaft 3 when the middle shaft 3 is fitted from front, the twist or the like of the ring 8 is prevented.

Further, though the retracting mechanism in this embodiment uses a so-called David cam mechanism (rotational cam mechanism) configured of a cam cylinder 9, a rotor 10, a slider 11, a knocking member 11*a* fixed to that slider 11, a cam spring 12, a forward spring 13 and so forth, the configuration is not limited to this, but a retracting mechanism may, for instance, use clip manipulation or be a screwing-out mechanism. Furthermore, the writing tool may as well have no retracting mechanism, and be fitted with a cap covering the writing part. Since this retracting mechanism is well known by a structure which makes the writing tip retractable by knocking, for instance by knocking the rear end, it is supposed to be as illustrated (FIG. 4) and its detailed description will be dispensed with.

A plurality of finger-contact portions such as concave portions 1*d* are formed in the surface of the grip portion 1, and the concave portions 1*d* are coated with a rubber-like paint whose surface is relatively smooth, but the concave portions 1*d* may as well be molded as another member and partially embedded into the grip portion 1. In other alternative, the concave portions 1*d* may be molded integrally by such means as two-colored molding. In this configuration, the two parts may be the same in hardness but different in color, or differentiated in hardness, but where they are to be differentiated in hardness, it is preferable for the concave portions 1*d* to be greater in hardness. More specifically, it is preferable for the concave portions 1*d*, with which fingers are to come into contact, to be 50 to 70 in Shore hardness and for other parts to be 20 to 50 in Shore hardness.

Although typical materials for the grip portion 1 include silicone rubber, nitrile butadiene rubber, natural rubber, styrene rubber, styrene butadiene rubber, butadiene rubber, chloroprene rubber and urethane rubber, the choice is not limited to these, but the material can also be selected from various other alternatives.

Instead of the hardness, each may as well be differentiated in surface roughness from others. This differentiation may be achieved through coating as described or by such means as two-colored molding. More specifically, it is preferable for the surface of the concave 1*d*, namely the part with which fingers are to come into contact, to be shaped relatively rough and those of other parts to be relatively smooth. The anti-slip effect would be enhanced and an improved feeling of grip can be expected.

Figure 7:
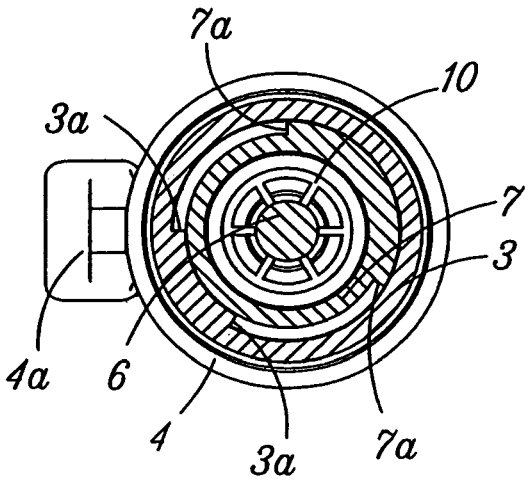
FIG. 7 shows a section along line B-B arrowed in FIG. 4.

Further, as shown in FIG. 7, arciform rotational engaging grooves 3*a* are partially formed in the inner circumferential face of the middle shaft 3, and arciform stubs 7*a* partially formed on the outer circumferential face of the linking member 7 are engaged with the rotational engaging grooves 3*a*. The contact and engagement of these rotational engaging groove 3*a* and stubs 7*a* prevent the middle shaft 3 and the rear shaft 4 (the grip portion 1) from rotating excessively, and rotational deforming stress is thereby prevented from working on the grip portion 1 more than necessary. Rotation of the middle shaft 3 and the rear shaft 4 relative to each other by about 90 degrees in one direction causes the stubs 7*a* of the linking member 7 to come into contact with ends of the rotational engaging grooves 3*a* in the middle shaft 3 to restrict the relative rotation in this embodiment, but this rotational angle (range) can be set as appropriate.

Figure 8:
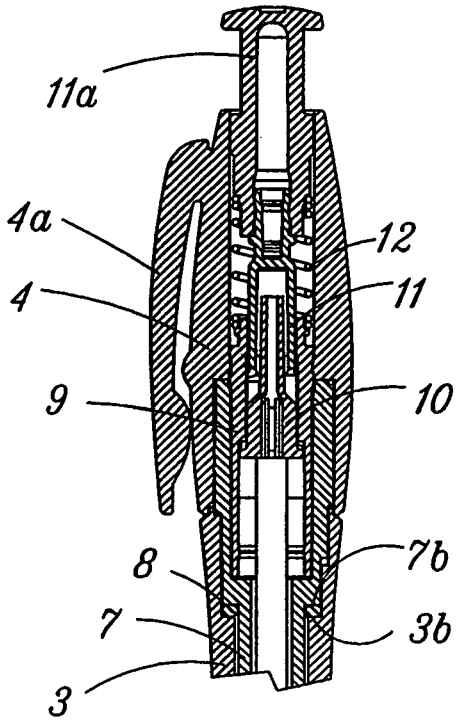
FIG. 8 shows a longitudinal section of the essential part of a variation of means for keeping rotating actions.

Next will be described a variation of the way of providing a frictional resistance force against the relative rotation of the middle shaft 3 and the linking member 7 with reference to FIG. 8. An internal step 3*b* is formed on the inner circumferential face of the middle shaft 3. On the other hand, an external step 7*b* is formed on the outer circumferential face of the linking member 7. Between the internal step 3*b* and the external step 7*b*, there is crimped the ring 8 whose section consists of a circular soft member. Crimping of the ring 8 provides frictional resistance against the relative rotation of the middle shaft 3 and the linking member 7. Although typical materials for the ring 8 in the foregoing example and this example include rubber-like elastic materials such as silicone rubber, nitrile butadiene rubber, natural rubber, styrene rubber, styrene butadiene rubber, butadiene rubber, chloroprene rubber and urethane rubber, the material can as well be selected from such soft resin materials as polyethylene, polypropylene and polyethylene terephthalate.

Figure 9:
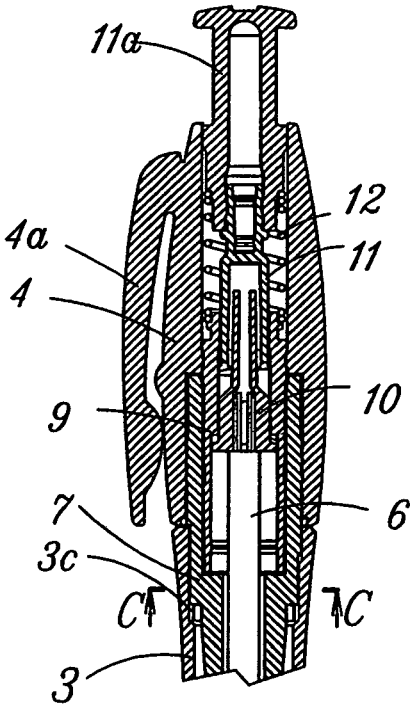
FIG. 9 shows a longitudinal section of the essential part of another variation of means for keeping rotating actions.
Figure 10:
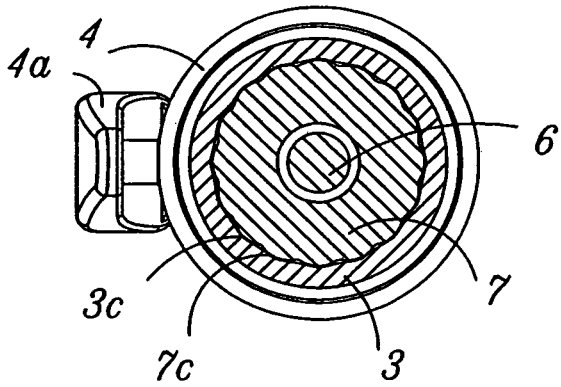
FIG. 10 shows a section along line C-C arrowed in FIG. 9.

The example shown in FIG. 9 and FIG. 10 is another variation of the way of providing a frictional resistance force against the relative rotation of the middle shaft 3 and the linking member 7. A plurality of undulating ribs 3*c* are formed on the inner circumferential face of the middle shaft 3. On the other hand, undulating engaging ribs 7*c* which can be engaged with or disengaged from and can override the ribs 3*c* are formed on the outer circumferential face of the linking member 7. The engagement of these ribs 3*c* and engaging ribs 7*c* maintains the rotational deformation of the grip portion 1 by a restoring force.

However, when the grip portion 1 is rotationally deformed, the grip portion 1 is also extended in the lengthwise direction, and its substantive hardness increases and at the same time a stress to restore it from the extension also occurs. This may give rise to a gap in the joint between the forward shaft 2 (the middle shaft 3) and the grip portion 1. In order to prevent this gap, each shaft can be fixed to the grip portion by adhesion or thermal fusion. Instead, the grip portion 1 may be formed longer than the fitting portion of the shaft cylinder 1, and the grip portion 1 in a state of compression in the lengthwise direction may be fitted to the middle shaft 3.

Figure 11:
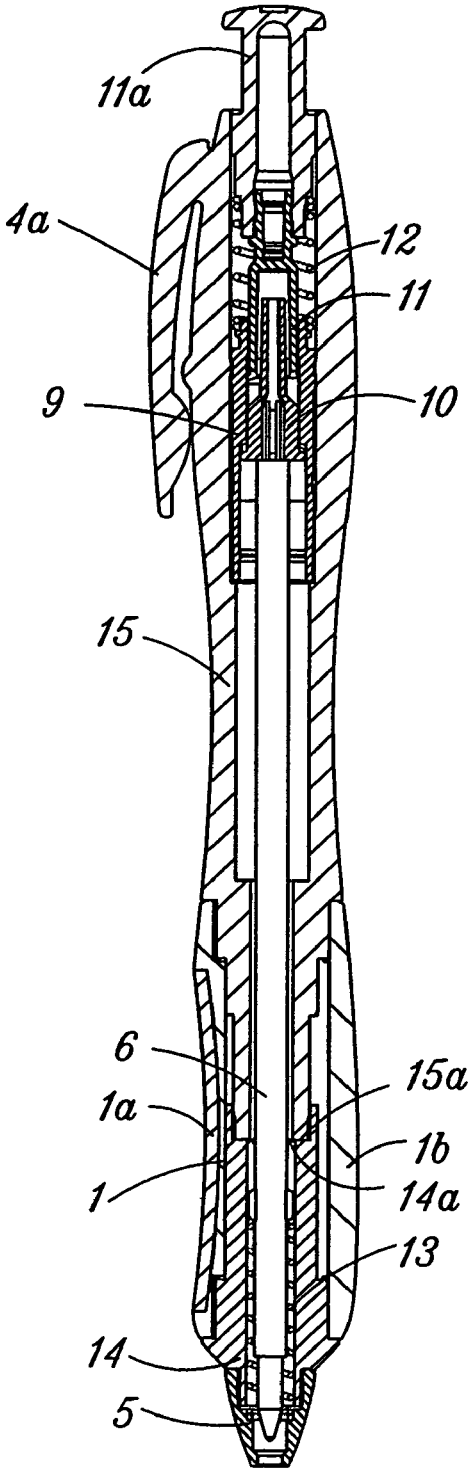
FIG. 11 shows a longitudinal section of still another variation of means for keeping rotating actions.
Figure 12:
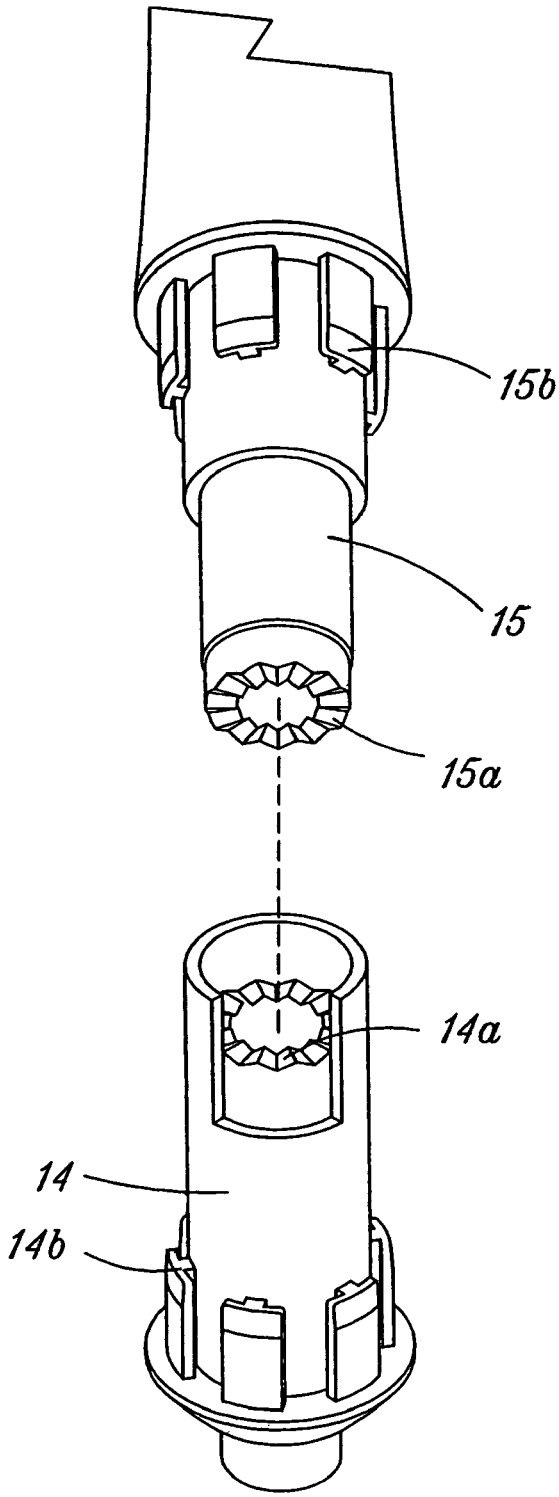
FIG. 12 is an exploded perspective view showing the essential part of FIG. 11.

In the example shown in FIG. 11 and FIG. 12, a forward shaft 14 and a rear shaft 15 are rotatably linked to each other to constitute the shaft body. Thus, the linking member 7 in the foregoing example is not used with a view to reducing the production cost. A detailed description will follow. The rear end of the grip portion 1 is fixed to the middle part of the rear shaft 15, while the forward end of the grip portion 1 is fixed to the forward part of the forward shaft 14. When the forward shaft 14 and the rear shaft 15 are rotated relative to each other, a twist is produced to the grip portion 1. In this example, too, there is arranged means of providing a frictional resistance force against the relative rotation of the rear shaft 15 and the forward shaft 14. Thus, a plurality of ribs 14*a* and 15*a*, which slidably contact each other, are radially formed at the rear end of the rear shaft 15 and the forward end of the forward shaft 14. Further, the rear shaft 15 and the forward shaft 14 are urged toward each other all the time to keep the ribs 14*a* and the ribs 15*a* in contact with each other. The urging force is achieved as the grip portion 1, which is fixed to both the forward shaft 14 and the rear shaft 15, draws one shaft toward the other. Thus, in this embodiment the rear shaft 15 is fixed to the forward shaft 14 in a state that the grip portion 1 is extended beyond its natural length. Since a stress to contract the grip portion 1 arises as a result, there occurs an action to draw and urge the rear shaft 15 and the forward shaft 14 to each other. However, the aforementioned urging force may be brought to act by another means or member, such as a coil spring or some other springy member. In such a configuration as described, a relative rotation between the rear shaft 15 and the forward shaft 14 will make their respective ribs 14*a* and 15*a* override each other thereby to rotationally deform or twist the grip portion 1 and, at the time the overriding is completed, the deformed, twisted shape is maintained.

Reference numerals 14*b* and 15*b* denote T-shaped stubs which, like their counterparts in the foregoing examples, are inserted into, for engagement with, T-shaped grooves in the grip portion 1 (for instance, the T-shaped grooves 2*b*, shown in FIG. 4 and FIG. 6).

Figure 13:
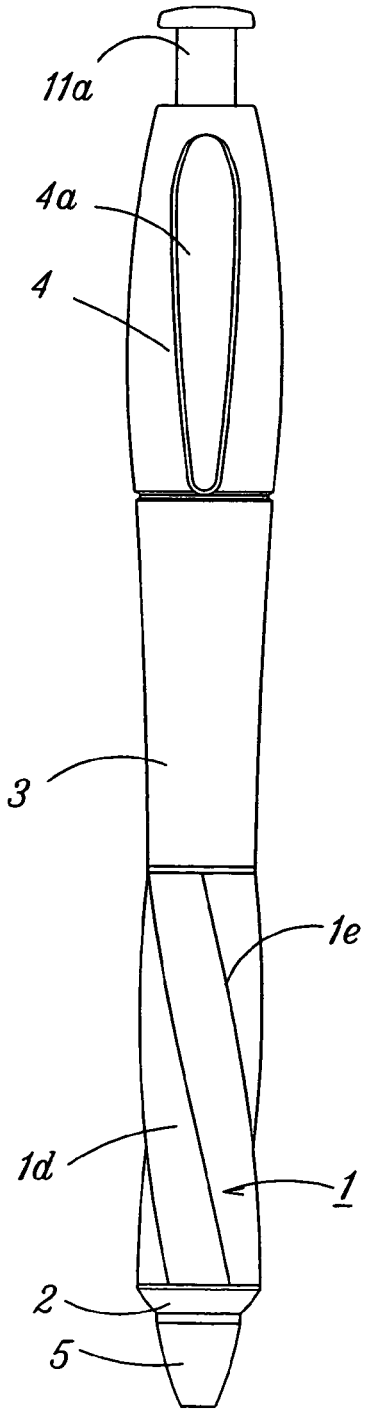
FIG. 13 is an external view showing of a variation of the grip portion.
Figure 14:
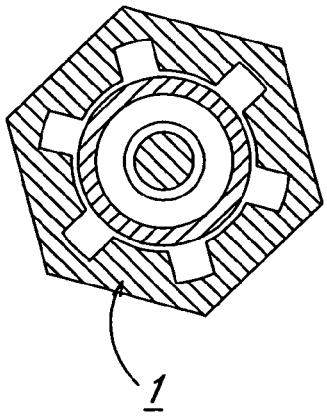
FIG. 14 shows a cross section of an example before the action shown in FIG. 13.
Figure 15:
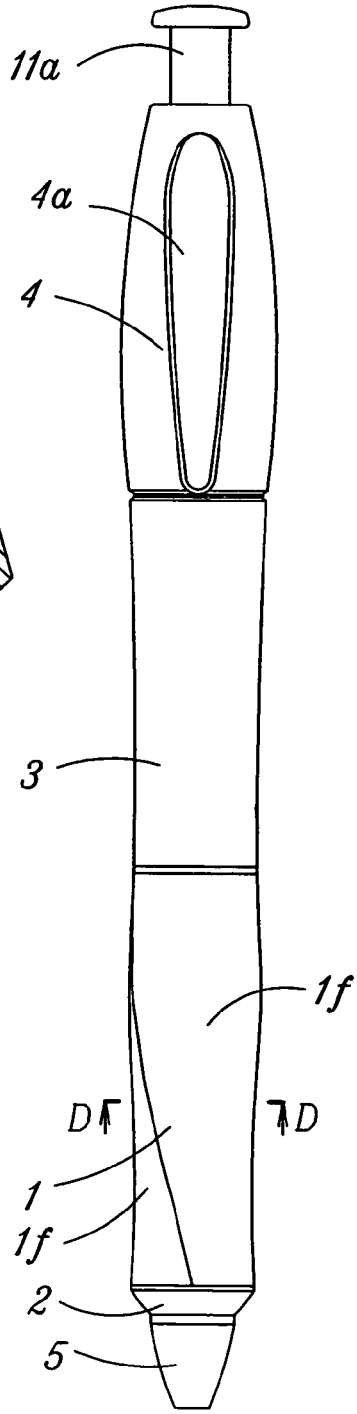
FIG. 15 is an external view showing another variation of the grip portion.

Whereas the concave portion 1*d* consisting of a recessed arc is formed in the grip portion 1 in the foregoing embodiments to facilitate fitting of the concave portion 1*d* to the gripping fingers when rotational deformation has been achieved to an appropriate extent, the specific shape of the grip portion can be selected as appropriate. A shape is shown in FIG. 13 through FIG. 15 for instance. Though it is a stripe shape of a substantially hexagonal column extending in the longitudinal direction in a state that the grip portion 1 is not rotationally deformed (see FIG. 14), it is deformed into a spiral stripe once it is rotationally deformed (see FIG. 13). Thus, a convex portion 1*e* and a concave portion 1*d* are formed on and in the stripe-deformed grip portion 1.

Figure 16:
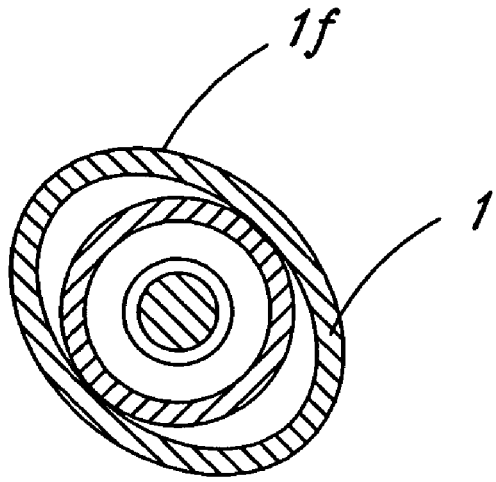
FIG. 16 shows a section along line D-D in FIG. 15.

Also, the shape shown in FIG. 15 and FIG. 16 is also desirous. The grip portion 1 maintains a substantially cylindrical shape in section when it is not rotationally deformed. Once it is rotationally deformed, it varies into a shape whose central portion is flat (flat portion 1*f*) (see FIG. 15 and FIG. 16).

Figure 17:
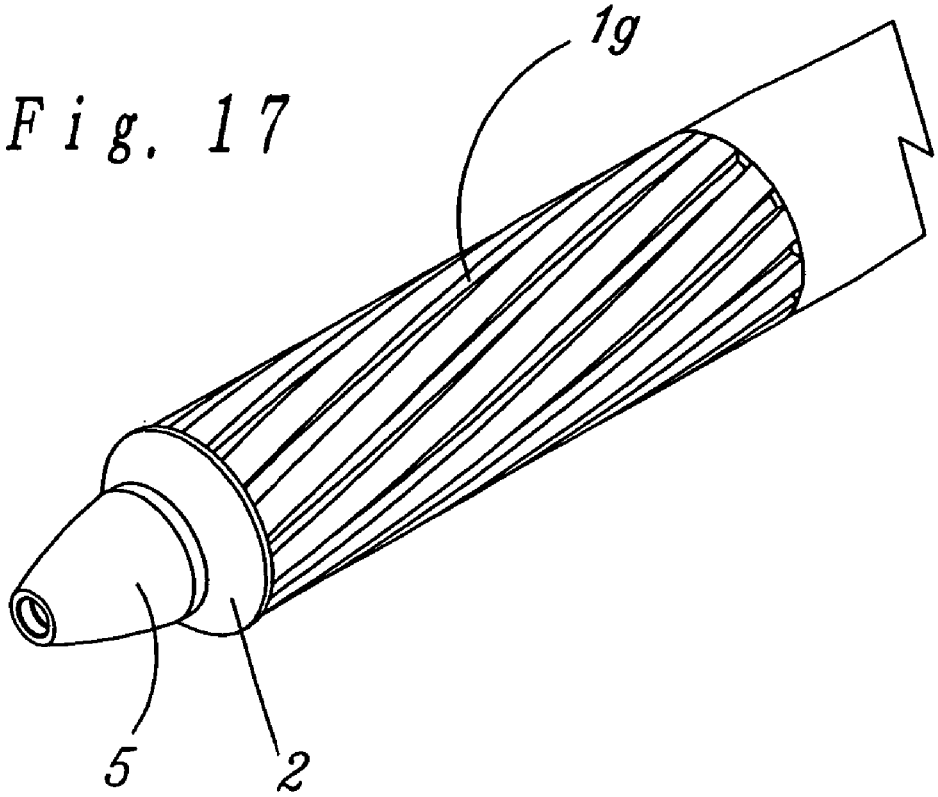
FIG. 17 is an external perspective view showing still another variation of the grip portion.
Figure 18:
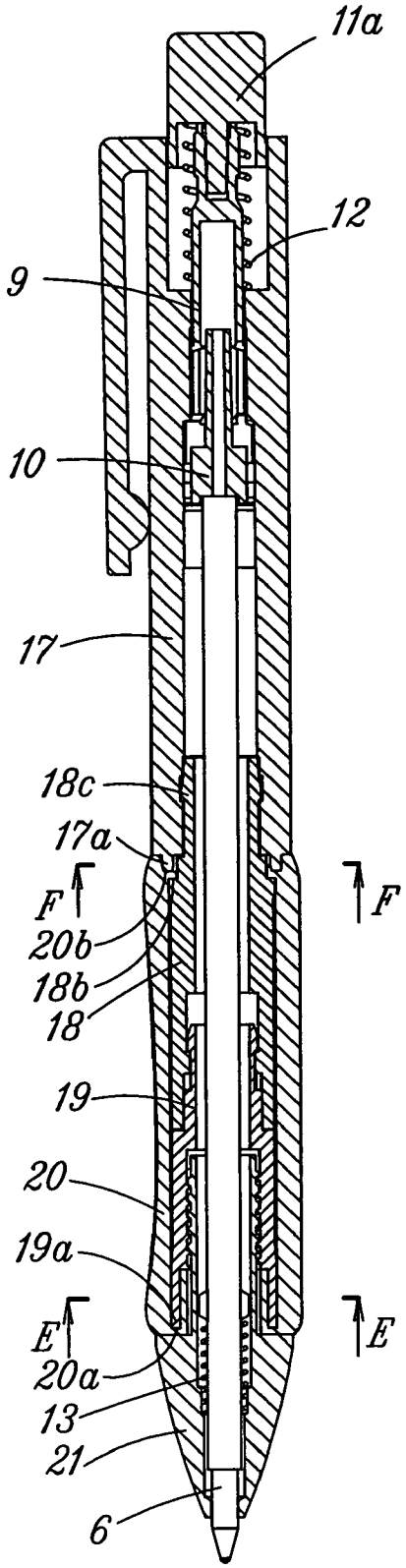
FIG. 18 shows a longitudinal section of a variation of the means of fixing the grip portion to the shaft body.
Figure 19:
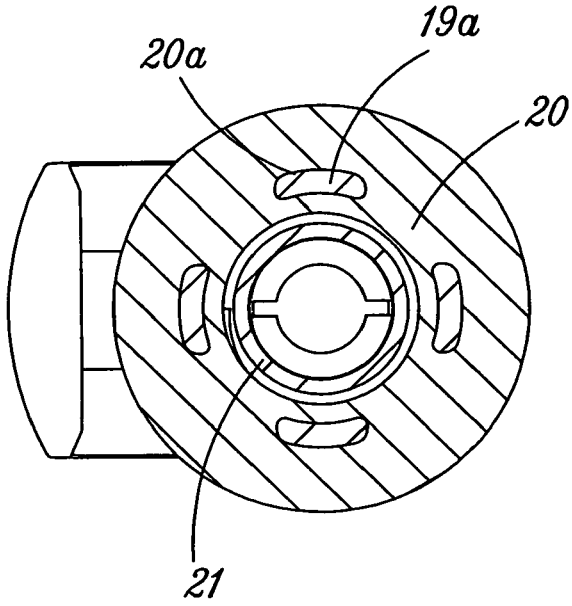
FIG. 19 shows a section along line E-E in FIG. 18.
Figure 20:
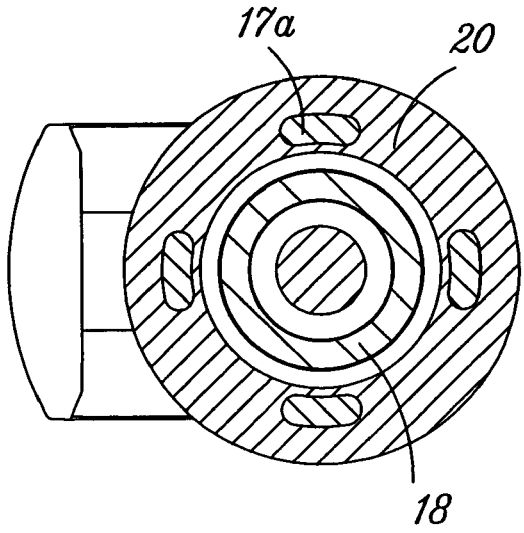
FIG. 20 shows a section along line F-F in FIG. 18.
Figure 21:
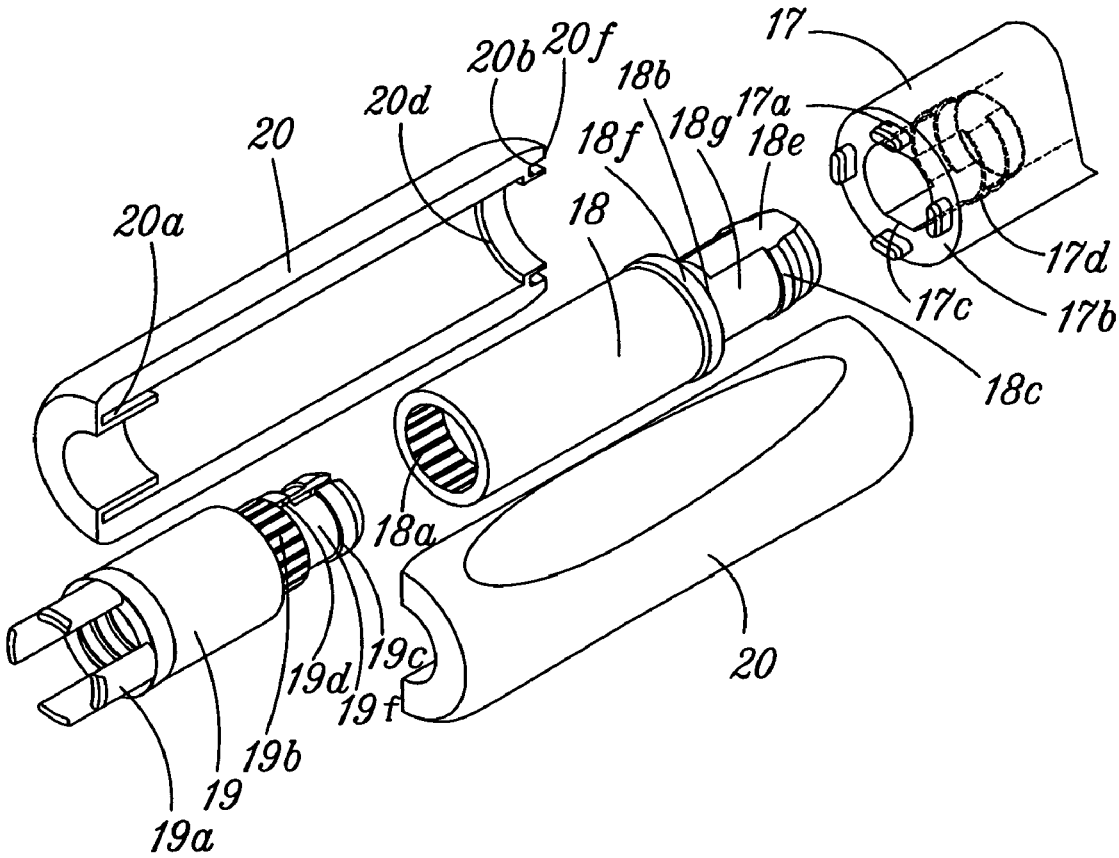
FIG. 21 is an exploded perspective view showing the essential part of FIG. 18.

Further, another example shown in FIG. 17 can be used. The grip portion 1 has many grooves 1*g* which are formed in the longitudinal direction when it is not rotationally deformed. The grooves 1*g* are deformed in spiral rotation when it is subjected to rotational deformation.

While many different examples have been explained in the foregoing description, in any of these examples a shape of the grip portion matching the preference of, or more suitable for, the user who holds the grip portion can be easily obtained by appropriate and selective rotational deformation.

Next, various examples of variation of fixing means for fixing the grip portion to the shaft will be described with reference to FIG. 18 through FIG. 21. The shaft cylinder is composed of a rear shaft cylinder 17, a middle shaft cylinder 18 and a forward shaft cylinder 19. The rear shaft cylinder 17 and the middle shaft cylinder 18 are unrotatably coupled to be unable to come off in the lengthwise direction while pinching between them an engaging step portion 20*d* of a grip 20. Also, the middle shaft cylinder 18 and the forward shaft cylinder 19, though rotatable relative to each other around the central axis of the shaft cylinder, are coupled to be unable to come off in the lengthwise direction.

Ahead of the forward shaft cylinder 19, there are formed a plurality of longitudinally extending stubs 19*a* whose section is substantially arciform partially, and they are inserted into respectively matching ones of holes 20*a* which are formed in a forward part of the inside of the grip 20 and have substantially the same shape in section. These stubs 19*a* and holes 20*a*, though formed in four positions radially in this example, may instead be in three or five positions even in only one position, but preferably they should be formed in about four positions. Tapered faces 19*e* are formed at the tips of the stubs 19*a* to facilitate their insertion into the holes 20*a*. Also an end piece 21 is fitted to the forward end of the forward shaft cylinder 19, and this end piece 21 is detachably fitted with a screw mechanism.

On the other hand, a plurality of stubs 17*a* which extend in the direction of the length of the shaft cylinder and whose section is either elliptic or substantially arciform in part are formed ahead of the rear shaft cylinder 17, and they are inserted into respectively matching ones of holes 20*b* which are formed in the rear end face 20*f* of the grip 20 and whose section has substantially the same shape as the stubs 17*a*. Also, a reduced-diameter part 18*g* is formed in the rear part of the middle shaft cylinder 18, and rear flat portions 18*e* are provided in two opposite positions on the reduced-diameter part 18*g*. On the arciform side of the reduced-diameter part 18*g*, there is provided a protruding part 18*c* which is greater than the reduced-diameter part 18*g* in diameter. Further, an outer diameter part 18*f* of a greater diameter is formed in the linking part between the middle shaft cylinder 18 and the reduced-diameter part 18*g*, and an engaging step portion 18*b* is formed as a result of the formation of the outer diameter part 18*f*. In addition, in the forward part of the inside of the rear shaft cylinder 17, there are formed flat faces 17*c* matching the flat portions 18*e* formed on the middle shaft cylinder 18 and a larger diameter part 17*d* matching the protruding part 18*c*.

A reduced-diameter part is formed in the rear part of the inside of the grip 20, and an engaging step portion 20*d* is formed as a result of the formation of this reduced-diameter part.

These features of configuration cause the middle shaft cylinder 18 and the rear shaft cylinder 17 to be unrotatably coupled by the engagement of their respective flat portions 18*e* and flat portions 17*c*, and longitudinally releasable by the engagement of the larger-diameter protruding part 18*c* of the middle shaft cylinder 18 with the matching larger diameter part 17*d* of the rear shaft. At the same time, by pinching the engaging step portion 20*d* inside the grip 20 and the rear end face 20*f* between the engaging step portion 18*b* of the middle shaft cylinder 18 and the forward end face 17*b* of the rear shaft cylinder 17, the rear part of the grip 20 is also made unrotatable relative to the middle shaft cylinder 18 (and the rear shaft cylinder 17) and coupled to be unable to come off in the lengthwise direction.

Also, a reduced-diameter part 19*f* is formed on the rear external face of the forward shaft cylinder 19, and a plurality of arciform stubs 19*b* which extend in the lengthwise direction are formed all over around the reduced-diameter part 19*f*. On the other hand, grooves 18*a* whose section is arciform are formed all over the internal face of the middle shaft cylinder 18 and in the lengthwise direction. The number of the stubs 19*b* of the forward shaft cylinder 19 and that of the grooves 18*a* of the middle shaft cylinder 18 are equal, and the stubs 19*b* and the grooves 18*a* are engaged with each other. Reference numeral 19*c* denotes an engaging step portion which links the middle shaft cylinder 18 and the forward shaft cylinder 19.

In the configuration described above, when the forward shaft cylinder 19 and the middle shaft cylinder 18 are rotated relative to each other, rotation takes place while the stubs 19*b* override grooves 18*a*. Then, though the grip 20 deformed by the rotation tries to restore its form, the rotationally deformed shape of the grip is maintained because the engaging force between the stubs 19*b* and the grooves 18*a* is greater than that restoring force. Further, a rotation restricting part 19*d* is provided behind the stubs 19*b* of the forward shaft cylinder 19, and the rotation restricting part 19*d* can be placed into contact with a rotation restricting part provided behind the grooves 18*a* of the middle shaft cylinder 18. In other words, by restricting the rotational angle between the forward shaft cylinder 19 and the middle shaft cylinder 18, excessive rotation deformation of the grip 20 is regulated thereby to prevent damage and other troubles.

Besides, in the process of rotational deformation of the grip 20, too, the grip 20 tries to restore its form from the rotationally deformed state, but the engagement between the holes 20*a* of the grip 20 and the stubs 19*a* of the forward shaft cylinder 19 and the aforementioned coupling of the rear part of the grip 20 with the middle shaft cylinder 18 and the rear shaft cylinder 17 maintain the rotationally deformed shape.

Figure 22:
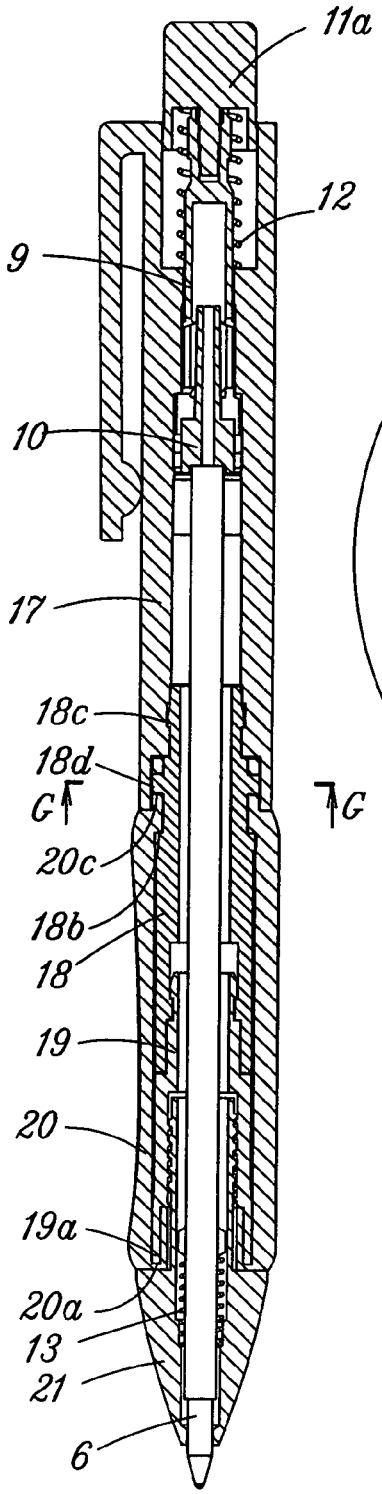
FIG. 22 shows a longitudinal section of shows a longitudinal section of a variation of the means of fixing the grip portion to the shaft body.
Figure 23:
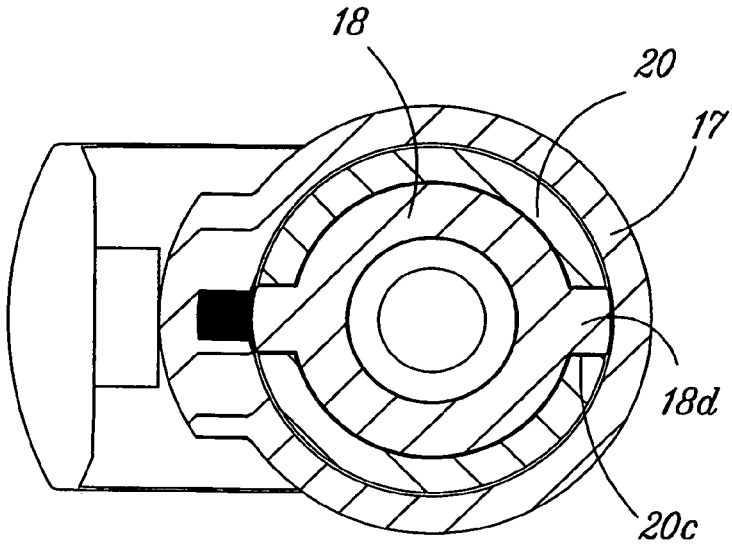
FIG. 23 shows a section along line G-G in FIG. 22.
Figure 24:
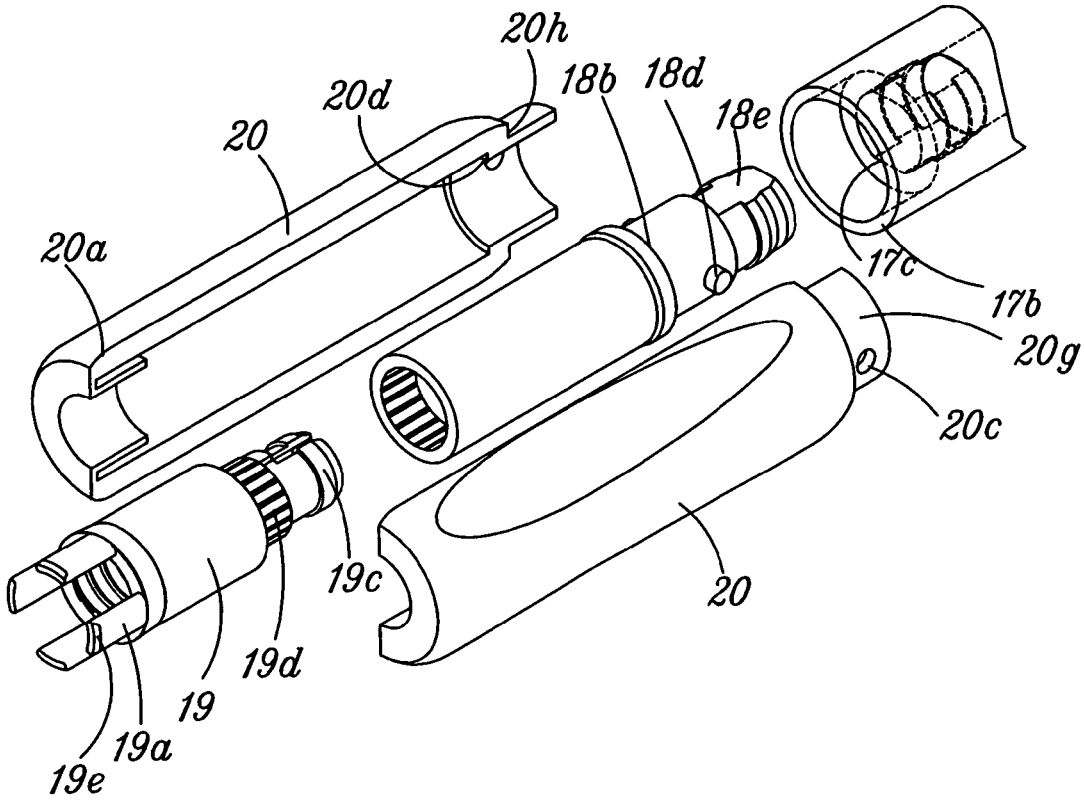
FIG. 24 is an exploded perspective view showing the essential part of FIG. 22.

Another variation will be described with reference to FIG. 22 through FIG. 24. A plurality of holes 20*c* substantially orthogonal to the direction of the length of the shaft cylinder are formed in a side face of a reduced-diameter part 20*g* covered by the rear shaft cylinder 17 behind the grip 20, while stubs 18*d* which is in a snap-fit engagement with the holes 20*c* are formed behind the middle shaft cylinder 18. In other words, the middle shaft cylinder 18 is unrotatably coupled to the rear shaft cylinder 17 in a state engagement with the holes 20*c* of the grip 20 such that the cylinders 17 and 18 are unreleasable in the lengthwise direction and unable to come off. Furthermore, the engaging step portion 18*b* of the middle shaft cylinder 18 and the forward end face 17*b* of the rear shaft cylinder 17 are held in a pinching way between the engaging step portion 20*d* formed in the rear part of the inside of the grip 20 and an engaging step portion 20*h* formed in the rear part of the outside of the grip 20. The configuration is the same as in the foregoing examples in respect of other elements, which will only be denoted by reference numerals in the drawings but whose detailed description will be dispensed with.

Figure 25:
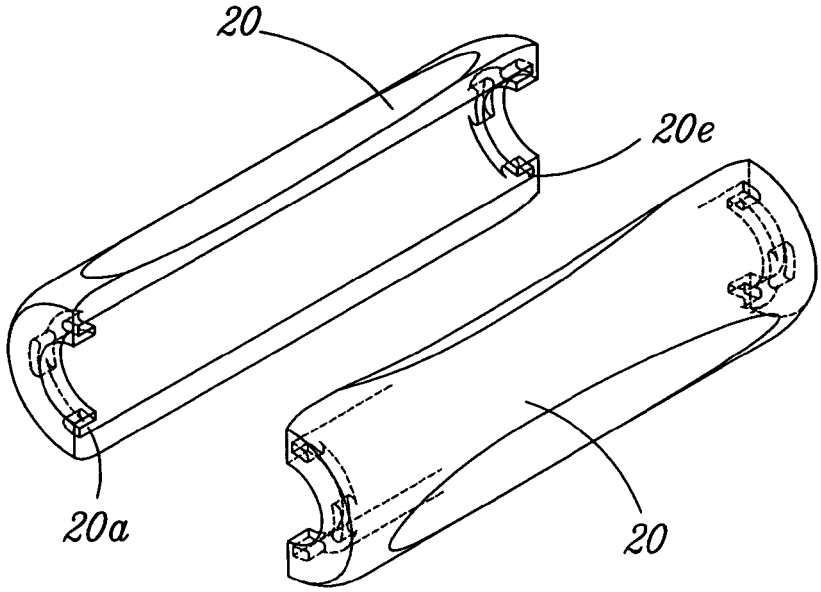
FIG. 25 is an exploded perspective view showing the essential part of the variation of the means of fixing the grip portion to the shaft body.

Still another example of variation will be described with reference to FIG. 25. In the rear part of the inside of the grip 20, like in the forward part of the inside, a plurality of holes 20*e* extending substantially in parallel to the direction of the length of the shaft cylinder are formed, and the holes 20*e* are engaged with a plurality of stubs formed behind the middle shaft cylinder 18. The configuration is the same as in the foregoing examples in respect of other elements, whose detailed description will be dispensed with.

Though the plurality of the holes 20*e* of the grip 20 in this embodiment are blocked on the rear side, their rear ends may be open, namely they may be through holes, for the convenience of molding.

INDUSTRIAL APPLICABILITY

The present invention, by virtue of its structure and its actions described so far, can solve the problems noted above and provide an excellent variable grip structure. Thus, since an elastic member and a shaft body to which the elastic member is fixed are designed to be relatively rotatable and suitable means for keeping their relative rotating actions is provided, adaptation is made possible by the relative rotation of those shaft body and elastic member to the hand size and preference of the user, which may vary individually from one user to the other. Further, there is an additional advantage of allowing an appropriate degree of hardness to be selected and maintained. Moreover, these can be achieved by a relatively simple component configuration.

The invention claimed is:

1. A variable grip structure, comprising: a shaft body having a forward shaft portion and a rearward shaft portion that are rotatable relative to one another about a longitudinal axis of the shaft body; and an elastic finger-grip member disposed around and encircling the shaft body, the elastic finger-grip member having a forward part fixed to the forward shaft portion and a rearward part fixed to the rearward shaft portion so that relative rotation of the forward and rearward shaft portions elastically twists the elastic finger-grip member about the longitudinal axis.

2. A variable grip structure according to claim 1; including means for retaining the forward and rearward shaft portions in a relatively rotated state to thereby retain the elastic finger-grip member in an elastically twisted state.

3. A variable grip structure according to claim 2; wherein the means for retaining comprises ribs on the forward shift portion that releasably engage with ribs on the rearward shaft portion.

4. A variable grip structure according to claim 2; wherein the means for retaining comprises a friction member interposed between the forward and rearward shaft portions.

5. A variable grip structure according to claim 1; wherein the forward and rearward shaft portions each have plural projections connected thereto and extending outwardly thereof, and the forward and rearward parts of the elastic finger-grip member each have plural recesses in which are engaged respective ones of the projections to thereby non-rotatably fix the foward and rearward parts of the elastic finger-grip member to the forward and rearward shaft portions.

6. A variable grip structure according to claim 5; wherein the sectional shape of the projections and recesses is generally T-shaped.

7. A variable grip structure according to claim 1; wherein the elastic finger-grip member has finger-contact portions that have a hardness different from other portions of the finger-grip member.

8. A variable grip structure according to claim 1; wherein the elastic finger-grip member has finger-contact portions that have a surface roughness different from other portions of the finger-grip member.

9. A variable grip structure according to claim 1; wherein the elastic finger-grip member has finger-contact portions that have a color different from other portions of the finger-grip member.

10. A variable grip structure, comprising: a shaft body having forward, middle and rearward shaft portions that are disposed in series along a longitudinal axis of the shaft body, and a linking member extending axially through the middle shaft portion and being rotatable relative thereto, the linking member having a rearward end portion fixed to the rearward shaft portion and a foward end portion fixed to the forward shaft portion; and an elastic finger-grip member disposed around and encircling the shaft body, the elastic finger-grip member having a forward part fixed to the forward shaft portion and a rearward part fixed to the middle shaft portion so that relative rotation of the middle and rearward shaft portions elastically twists the elastic finger-grip member about the longitudinal axis.

11. A variable grip structure according to claim 10; including means for retaining the middle and rearward shaft portions in a relatively rotated state to thereby retain the elastic finger-grip member in an elastically twisted state.

12. A variable grip structure according to claim 11; wherein the means for retaining comprises a friction ring interposed between the middle and rearward shaft portions.

13. A variable grip structure according to claim 11; wherein the means for retaining comprises a plurality of undulating ribs formed on an inner circumferential face of the middle shaft portion, and a plurality of undulating ribs formed on an outer circumferential face of the linking member and slidably engageable with the undulating ribs formed on the middle shaft portion.

14. A variable grip structure according to claim 10; wherein the forward and middle shaft portion each have plural projections connected thereto and extending outwardly thereof, and the forward and rearward parts of the elastic finger-grip member each have plural recesses in which are engaged respective ones of the projections to thereby non-rotatably fix the foward and rearward parts of the elastic finger-grip member to the forward and middle shaft portions.

15. A variable grip structure according to claim 14; wherein the sectional shape of the projections and recesses is generally T-shaped.

16. A variable grip structure according to claim 10; wherein the elastic finger-grip member has finger-contact portions that have a hardness different from other portions of the finger-grip member.

17. A variable grip structure according to claim 10; wherein the elastic finger-grip member has finger-contact portions that have a surface roughness different from other portions of the finger-grip member.

18. A variable grip structure according to claim 10; wherein the elastic finger-grip member has finger-contact portions that have a color different from other portions of the finger-grip member.

19. A variable grip structure according to claim 10; including means for limiting the extent of relative rotation of the middle and rearward shaft portions.

20. A variable grip structure according to claim 19; wherein the means for limiting comprises an arcuate groove formed in the middle shaft portion, and means on the linking member for engaging with opposite ends of the arcuate groove to limit rotation of the middle and rearward shafts relative to each other.

21. A variable grip structure according to claim 10; wherein the forward, middle and rearward shaft portions each have a tubular shape, and the linking member has a tubular shape and extends axially inside the forward, middle and rearward shaft portions.

* * * * *